United States Patent [19]

Nagai

[11] Patent Number: 4,463,514

[45] Date of Patent: Aug. 7, 1984

[54] TOY HAVING PIVOTING MEMBERS

[75] Inventor: Yoshitoshi Nagai, Tokyo, Japan

[73] Assignee: Tomy Kogyo Company, Inc., Japan

[21] Appl. No.: 398,685

[22] Filed: Jul. 15, 1982

[30] Foreign Application Priority Data

Aug. 26, 1981 [JP] Japan ..... 56-126362[U]

[51] Int. Cl.[3] ..... A63H 13/02

[52] U.S. Cl. ..... 446/294

[58] Field of Search ..... 46/105, 104, 103, 149, 46/123, 97, 98, 102, 206

[56] References Cited

U.S. PATENT DOCUMENTS

| | | | |
|---|---|---|---|
| 2,012,343 | 8/1935 | Goriup | 46/206 |
| 2,232,615 | 2/1941 | Kupka | 46/104 |
| 2,593,991 | 4/1952 | Crosby | 46/105 |
| 2,605,585 | 8/1952 | Sebel | 46/105 |
| 2,716,838 | 9/1955 | Quercetti | 46/105 |
| 3,765,693 | 10/1973 | Morrison et al. | 46/104 X |

*Primary Examiner*—Mickey Yu

*Attorney, Agent, or Firm*—K. H. Boswell; Edward D. O'Brian

[57] ABSTRACT

A toy which is capable of moving over a support surface includes a body having a first member. At least a portion of the body is capable of contacting a support surface. The member has ends and is pivotally mounted to the body about one of its ends. A driving mechanism is located in the toy with at least a portion of the driving mechanism located at the second end of the member. This portion of the driving mechanism is capable of moving the toy across a support surface. The member is movable with respect to the body by pivoting about its first end. The driving mechanism is activated upon pivotally moving the member with respect to the body. After being activated, the member is biased back to its original position and in doing so, that portion of the driving mechanism located at the second end of the member moves with respect to the member and engages the support surface to move the toy across the support surface.

11 Claims, 9 Drawing Figures

TOY HAVING PIVOTING MEMBERS

BACKGROUND OF THE INVENTION

This invention is directed to a toy having a body, at least one appendage attached thereto, a driving means located within the toy, and is activatable upon pivoting the appendage with respect to the body such that the driving means retracts the appendage back to the body and in so doing, drives a member which propels the toy across a support surface. The illustrative embodiment of the invention utilizes a toy figurine having front and rear appendages which, when spread apart from one another by depressing the body of the figurine, retract back toward one another, and in so doing roll the toy figurine across a support surface in response to rotation of a set of wheels located at the end of one of the appendages which are rotated in response to movement of the appendages back toward one another.

Many characterized figurine toys are known which are directed to pre-school children. The earliest of these date to antiquity and are of carved animals and the like.

Certain figurine type toys are known which employ wheels at the bottom of their extremities such that they can roll across support surfaces. In this class of toys are many riding toys and the like which a small child can actually ride upon. Furthermore, in this class are toys which are capable of being pulled across a support surface, or which move across a support surface under the influence of a winding mechanism or the like.

The majority of all of the toys in the above classifications have appendages which are fixedly held with respect to the body. Only a few of the above noted type toys have movable appendages. In this class of toys would be those toys which most closely mimic the shape of animals and the like. Movement of the appendages with respect to the body is made in order to better mimic the actual real-life animal counterpart or the like.

One U.S. patent, U.S. Pat. No. 3,563,363 is directed to a type of toy of the above classification which further includes rotating belts or the like which rotate around the ends of the appendages of the animal figurine to move the figurine over obstacles and the like. Further, the front and rear appendages of this toy are movable in a limited respect in order to better simulate movements of a living animal. This toy is propelled by the use of a small electric motor which requires batteries or the like. Other toys of this general classification date back for some years and include wind-up toys which, for example, are shown in very old patents such as U.S. Pat. No. 61,416 and a plurality of other patents which have issued since that time. These patents, as are exemplified by U.S. Pat. No. 61,416, rely on movement of two of four appendages, or one of four appendages at any one time to propel them. They do not utilize means located on the end of the appendage, as does the above noted U.S. Pat. No. 3,563,363 in moving the figurine across a surface.

A further class of characterized animal toys include those described in U.S. Pat. Nos. 2,613,080 and 3,911,613. In U.S. Pat. No. 3,911,613, an articulated animal figurine type toy is shown having appendages which have ball joints formed on the end such that the appendages can be moved with respect to the body. The body itself is articulated and is held together by rubber bands or the like. This toy, however, is incapable of moving under its own power in any way. In the disclosure of U.S. Pat. No. 2,613,080, a characterized animal is disclosed which is not necessarily of the toy figurine type, but more of a larger scale apparatus which can be utilized as a target at amusement parks and the like. In it, when a target is struck, a characterized animal performs a movement characteristic of its real-life counterpart.

Of the above described toys which are capable of moving over support surfaces, the use of electric motors and wind-up mechanisms utilizing keys or the like precludes successful play with the toy by a very small child. This use is precluded because of the lack of motor coordination to appropriately activate the toy.

BRIEF DESCRIPTION OF THE INVENTION

In view of the above, it is a broad object of this invention to provide a small figurine type toy which is capable of moving over a support surface upon activation of a driving mechanism wherein the driving mechanism is so activated by a movement of the toy which can be initiated by a small child and the like. It is a further object of this invention to provide a toy which can be so activated by simple depression of a portion of the toy toward a surface, thus allowing even very young children to activate the same. Further it is an object of this invention to so provide a toy which, because of its engineering and design is capable of withstanding rigorous play by a small child, but further capable of being assembled and manufactured at a reasonable cost, making it reasonably available to the consumer.

These and other objects, as will become evident from the remainder of this specification are achieved in a toy capable of moving on a support surface which comprises: a body having at least a first member attached thereto, said body including a surface contact means, said first member having ends, said first member pivotally mounted to said body about the first of its ends; a driving means located in said toy with at least a portion of said driving means located at the second of said ends of said first member, said portion of said driving means located at said second end comprising a moving means, said moving means movable with respect to said first member; said first member moving with respect to said body by pivoting about the first of its ends, in response to pivoting of said first member with respect to said body in a first direction said second end of said first member moving away from said surface contact means and concurrently at least a portion of said body moving downwardly toward said support surface and in response to said pivoting of said second member with respect to said body in the opposite direction said second end of said first member moving toward said surface contact means and concurrently at least said portion of said body moving upwardly away from said support surface; said toy supported on said support surface by said surface contact means and said moving means; said driving means being activated upon moving said first member in said direction wherein said second end of said first member moves away from said surface contact means and when so activated said driving means capable of moving said first member such that said second end of said first member moves toward said surface contact means and concurrently as said second end moves toward said surface contact means said moving means moving with respect to said first member, said movement of said moving means moving said moving means across the support surface to propel said toy across said support surface.

Preferredly, the surface contact means would comprise an extension on the body. Said extension would have a surface contact member with the surface contact member contacting the support surface to partially support the toy on the support surface in conjunction with the previously noted support contributed by the moving means.

Preferredly, the moving means comprises a movable rotating means capable of rotating in a first direction and a second direction with respect to the first member. The driving means would be capable of rotating the rotating means in said first direction when the driving means is activated and as the second end of the first member moves toward the contact surface means, said rotation of the rotating means in said first direction would be capable of moving the toy across the support surface. In the illustrative embodiment of the invention herein, the extension comprises a second member, which also has ends, and which is pivotally mounted to the body about one of its ends. The contact member would be located at the other end of the second member and in the illustrative embodiment comprises a second rotating means located at this end. The second rotating means would be capable of rotating on the support surface.

In this illustrative embodiment both the first member and the second member are pivotally attached to the body and move with respect to the body such that their ends which are not attached to the body move away from each other during activation of the driving means and after the driving means is so activated, the driving means is capable of moving the ends back toward one another such that the rotating means and the second rotating means are moved away from and toward one another during this movement.

In the illustrative embodiment, a coordinating means is operatively associated with both the first and second members. The coordinating means would transfer pivotal movement of one of these members with respect to the body into pivotal movement of the other. Preferredly, this pivotal movement would be simultaneous.

In the illustrative embodiment, both the rotating means and the second rotating means would each include at least one wheel located at the respective ends of the first and second members. The wheel on the second member would be freely rotatable and the wheel on the first member would be rotatable in said first direction by the driving means to drive the toy across the support surface, but would be freely rotatable with respect to rotation in the opposite direction.

Preferredly, the driving means would include a biasing means such as a spring. The bias in said spring or biasing means would be increased by pivoting the first and second members with respect to the body such that their opposite ends move away from each other, and upon increasing this bias, the increase in bias would tend to displace the first and second members backwardly in the opposite direction and in so doing, would rotate the wheel on the first member to propel the toy across the support surface.

Preferredly, the driving means would further include a gear train which would be capable of rotating the wheel on the first member to so propel the toy, The coordinating means would comprise a second gear train to communicate movement between the first and second members.

BRIEF DESCRIPTION OF THE DRAWINGS

This invention will be better understood when taken in conjunction with the drawings wherein.

Figure 1:
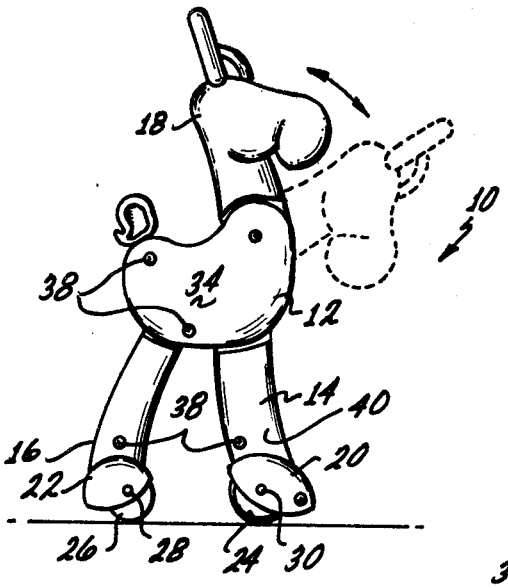
FIG. 1 is a side elevational view of the illustrative embodiment of the toy with one of the appendages of the toy shown in a first configuration in solid line and in a second configuration in phantom line.

The invention described in this specification and in the drawings attached hereto utilizes certain principles and/or concepts as are set forth and claimed in the claims appended to this specification. Those skilled in the toy arts will realize that these principles and/or concepts are capable of being expressed in a variety of illustrative embodiments. For this reason, this invention is not to be construed as being limited to the exact illustrative embodiment herein, but is only to being construed as being limited by the claims.

DETAILED DESCRIPTION OF THE INVENTION

Figure 2:
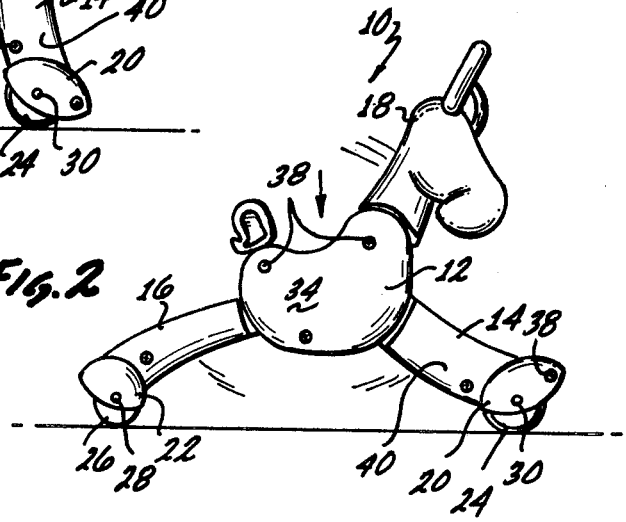
FIG. 2 is a side elevational view similar to FIG. 1 except that certain of the components of the toy of FIG. 1 are shown in a different spatial relationship than as seen in FIG. 1.
Figure 3:
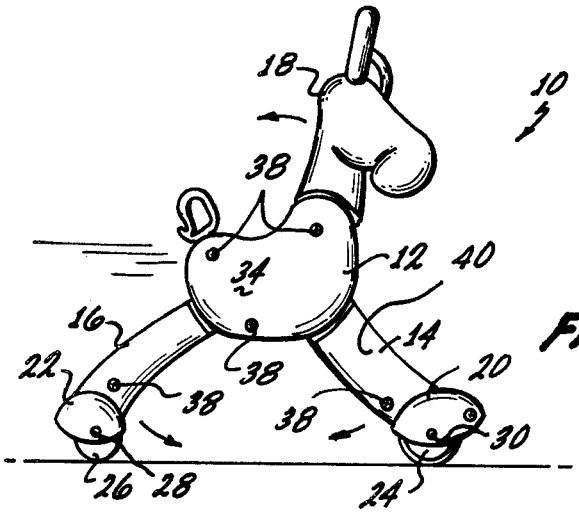
FIG. 3 is a view similar to FIGS. 1 and 2 with the components which are displaced in FIGS. 1 and 2 further displaced in even a different spatial configuration with respect to one another.

In FIGS. 1 through 3 there is shown a toy 10 which is shaped as a characterized animal. The toy 10 has a body 12, a front appendage 14, a rear appendage 16 and an upper appendage 18. The front appendage 14 is shaped as a front leg, with the rear appendage 16 shaped as a rear leg, and the upper appendage 18 shaped as a neck and head of a characterized animal of the deer family.

The toy 10 shown in FIGS. 1 through 3 is capable of exhibiting the following movements. The upper appendage 18 can be made to move between any one of a number of stepped positions such as the position shown in solid and phantom lines in FIG. 1. Upon depression of the body 12 downwardly toward a support surface, the front and rear appendages 14 and 16 are forced outwardly such that their bottom ends 20 and 22, respectively, are moved away from each other.

Upon release of the body 12 after it has been depressed toward the support surface, the front and rear appendages 14 and 16 move back toward each other such that their bottom ends 20 and 22 move toward each other, and in so doing, a set of front wheels, only one of which, wheel 24, is shown in the views projected in the drawings, are caused to rotate in a clockwise direction, as seen in FIGS. 1 and 3, such that the toy 10 is propelled forward or to the right as seen in the Figs.

This gives the toy 10 some inertia, and after the front and rear appendages 14 and 16 have assumed their position as seen in FIG. 1, the toy 10 continues rolling on both the front wheel 24 and on a like rear wheel 26, until the inertia of the toy 10 is lost and the toy 10 comes to a resting position.

The rear wheel 26, as with the front wheel 24, is one of a pair of wheels, the other of which is not seen in the Figs. The rear wheel 26 and its unseen mate are freely rotatable about an axle 28 on the rear appendage 16. If the toy 10 is being pushed by the child using it, the front wheel 24 and its unseen mate are freely rotatable about their axle 30 when they rotate in a clockwise direction as seen in FIGS. 1 through 3, but they also are driven by a driving mechanism, as hereinafter explained, in a forward, or clockwise, direction, as seen in FIGS. 1 through 3. The driven forward, or clockwise, direction of the front wheel 24 and its unseen mate drive the toy 10 forward.

When the body 12 of the toy 10 is pushed downwardly toward the support surface, the rear wheel 26 and the front wheel 24 free wheel on the support surface such that the ends 20 and 22 of the front and rear appendages 14 and 16, respectively, can move away from each other, allowing for activation of the toy 10. When the toy 10 is so activated and is released, the upward movement of the body 12, accompanied by the inward movement of the ends 20 and 22 toward one another, is allowed by the free rotation of the rear wheel 26 and its unseen mate as the toy 10 is propelled forward by the clockwise, or forward, rotation of the front wheel 24 and its unseen mate.

The driving mechanism, as hereinafter explained, is located within the interior of the toy 10 and links the front appendage 14 to the body 12. The driving mechanism is, in fact, activated by the movement of the front appendage 14 with respect to the body 12. In moving the front appendage 14 with respect to the body 12 in a counterclockwise direction, as viewed in the Figs. and as seen in moving from FIG. 1 to FIG. 2, the driving mechanism is activated. Once activated, this driving mechanism then is capable of moving the front appendage 14 back to its original position as seen in going from FIG. 2 to FIG. 3, and then to FIG. 1, and accompanying this movement of the front appendage 14 is concurrent movement of the rear appendage 16. The front appendage 14 and the rear appendage 16 are coordinated with one another, as hereinafter shown.

The upper appendage 18 is also coordinated with the movement of the front appendage 14. As noted earlier, the upper appendage 18 can be moved through a variety of positions, such as the position shown in solid and phantom line in FIG. 1. There is a limit, however, of the clockwise movement of the upper appendage 18 as is seen in FIG. 1. If the upper appendage 18 is moved to its maximum in a clockwise direction as is seen in FIG. 1, it will move no further when the body 12 is depressed toward the support surface. If, however, it is not moved to its maximum clockwise position as seen in FIG. 1 during depression of the body 12 toward the support surface, the upper appendage 18 moves further clockwise toward its maximum clockwise position. During return of the front appendage 14 from its position as seen in FIG. 2 to the position seen in FIG. 1, the upper appendage 18 concurrently returns counterclockwise to this upright position as seen in FIG. 1.

Figure 4:
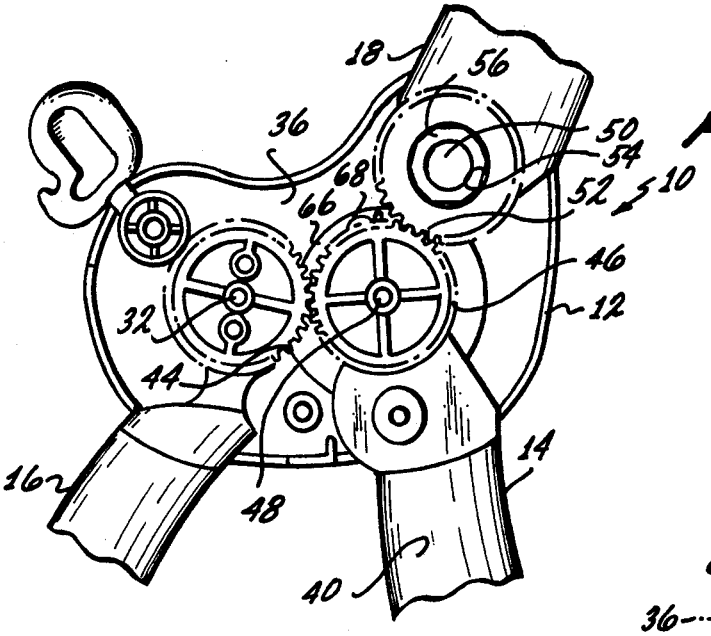
FIG. 4 is a side elevational view showing certain components in the interior of the toy of FIG. 1.

Moving now to FIG. 4, an interior view of the body 12 of the toy 10 is shown. In this Fig., an axle 32 is seen by which the rear appendage 16 is pivotally mounted to the body 12. The axle 32 would be appropriately mounted in bearing surfaces, not shown or numbered, formed on the inside of the body 12. The body 12 is constructed of two halves, the left hand side half 34 being seen in FIGS. 1 through 3 and the right hand side half 36 being viewable in FIG. 4. These halves, 34 and 36, are joined together by appropriate screws, collectively identified by the numeral 38, to hold them together after the internal components of the toy 19 have been so located within the body 12. The axle 32 woud be appropriately journaled in the above mentioned bearings appropriately formed in the left and right halves 34 and 36.

As with the body 12, the front and rear appendages 14 and 16 are formed of component parts which are screwed together by screws also collectively identified by the numeral 38 to hold them in position with respect to one another. In FIG. 1 the left side component 40 of the front appendage 14 is shown and in FIGS. 5 and 6, as well as 8 and 9, the right side component of the appendage 14 is shown.

A gear 44 is fixedly attached to the rear appendage 16 and has a center of rotation about the axle 32. An intermeshing gear 46 is fixedly attached to the component 40 of the front appendage 14 and has a center of rotation about an axle 48. The axle 48 serves as the mounting point of the front appendage 14 to the body 12 as well as carrying on it an additional component, as hereinafter explained. In any event, the gear 46 meshes with the gear 44 such that movement of one of the front or rear appendages 14 or 16 is transferred to movement of the other of the appendages 14 or 16. As with the axle 32, the axle 48 is appropriately journaled in bearings, not numbered or illustrated, located in the left and right body components 40 and 42 of the body 12. The two appendages 14 and 16 thus pivot about the axles 48 and 32 with respect to the body 12.

Figure 7:
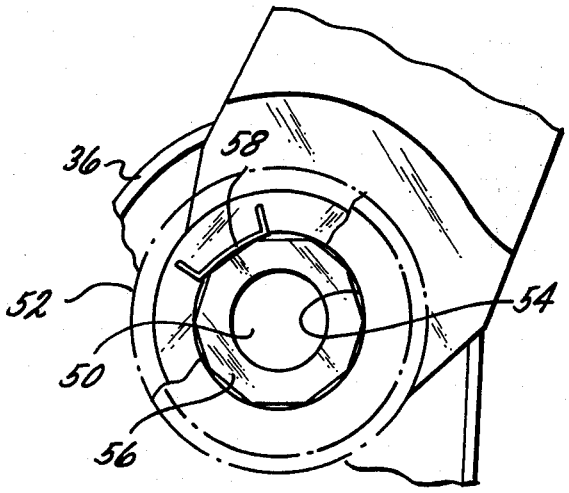
FIG. 7 is a side elevational view in partial section of a portion of the components seen in FIG. 4.
Figure 8:
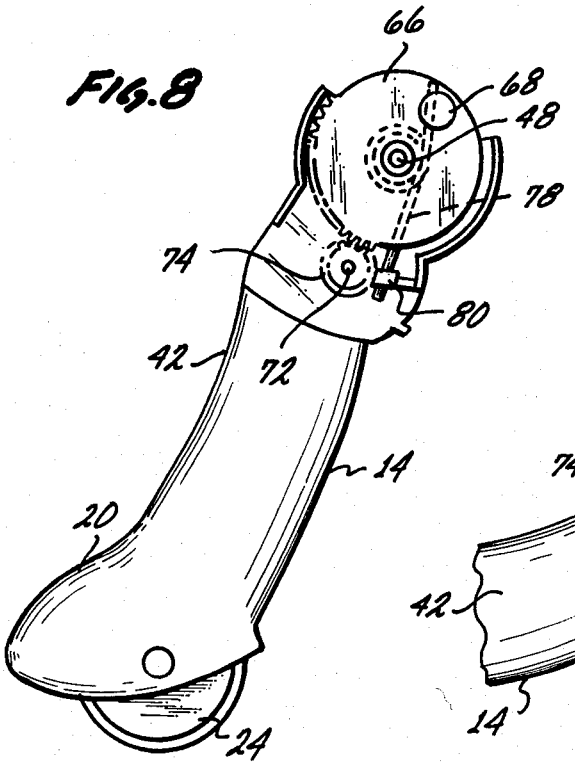
FIG. 8 is a side elevational view in partial section of the other side of the component seen in FIG. 5.
Figure 9:
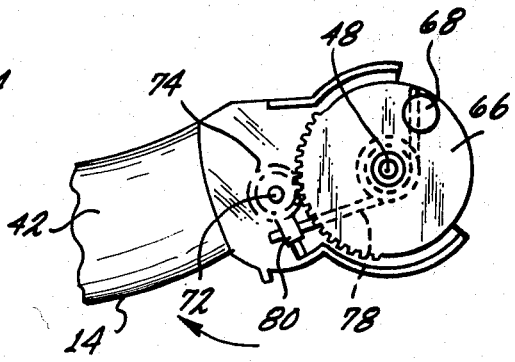
FIG. 9 is a side elevational view in partial section of the top portion of the component seen in FIG. 8.

The upper appendage 18 as is seen in FIG. 7 is pivotally mounted to the body 12 by locating it about a boss 50 formed as a part of the side component 36. Also located about the boss 50 is a gear 52 which meshes with gear 46 and thus rotates in response to rotation of gear 46.

The upper appendage 18 includes a hole 54 which, as can be seen in FIG. 7, is substantially larger than the diameter of the boss 50. A bushing 56, which is shaped as a polygon, slips over the boss 50 and frictionally engages in the hole 54 to attach the upper appendage 18 to the bushing 56 which holds it about boss 50. The fit between the bushing 56 and the boss 50 is not tight, thus allowing for free rotation thereon of the bushing 56 and thus the upper appendage 18.

The gear 52 loosely fits around the bushing 56. It includes on its under side a projection 58 which passively frictionally engages against the faces of the polygon shaped bushing 56. The bushing 56 moves in concert with the movement of the projection 58 if both the gear 52 and the upper appendage 18 are unrestrained, but there can be slippage between the bushing 56 and the projection 58 if one or the other of the gear 52 or the upper appendage 18 is restrained.

If the upper appendage 18 is moved from the position shown in solid lines to the position shown in phantom lines in FIG. 1 while the front appendage 14 is restrained by the bias of the spring as hereinafter identified and explained, the bushing 56 will slip with respect to the projection 58 to locate the projection 58 against a new face of the polygon surface of the bushing 56. Now, if the front appendage 14 moves forward to the position shown in FIG. 2 again, there will be slippage between the projection 58 and the bushing 56. When the front appendage 14 moves back from the position shown in FIG. 2 to the position shown in FIG. 1, rotary motion transferred from the gear 46 to the gear 52 will move the upper appendage 18 back to the position shown in solid lines in FIG. 1 by frictional engagement of the projection 58 with the bushing 56.

If the upper appendage 18 is in the position shown in FIG. 1 in solid lines and the body 12 is depressed as the front appendage 14 moves outwardly, frictional engagement of the projection 58 with the bushing 56 moves the appendage 18 to the phantom position. It can thus be seen that the upper appendage 18 can be prepositioned in either of the positions shown in solid or phantom line in FIG. 1 or some other position located between these two positions prior to movement of the front appendage 14, or, if unrestrained, the upper appendage will automatically be positioned in the position shown in phantom lines in FIG. 1 during forward movement of the front appendage 14.

Figure 6:
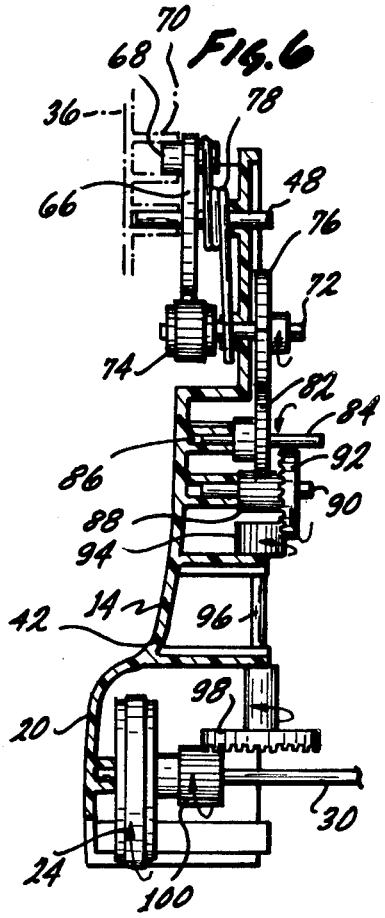
FIG. 6 is a rear elevational view in partial section about the line 6—6 of FIG. 5.

As was noted above, gear 46 moves in unison with front appendage 14 about axle 48. Both of these components are free wheeling about axle 48, allowing for pivoting of the front appendage 14 with respect to the body 12. Also mounted on axle 48 is a disk 66 having gear teeth over a portion thereof. Disk 66 is located close to the right side component 42 of the appendage 14. The disk 66 includes a peg 68 which passes through the disk 66 and projects outwardly on either of its sides. As seen in FIG. 6, on one side of the disk 66 the peg 68 fits into a hollow boss 70 formed on the inside surface of the right side body component 36. This prevents rotation of disk 66 with respect to the body 12 such that movement of the front appendage 14 about the axle 48 also results in movement of the appendage 14 with respect to the disk 66.

In looking at FIGS. 5, 6, 8 and 9, an axle 72 can be seen passing through the front appendage 14 below the axle 48. The axle 72 has a pinion 74 fixed to it and located on the outside of the wall of the component 42 of the front appendage 14. The pinion 74 meshes with the gear teeth on the disk 66. As the front appendage 14 moves with respect to the body 12, the pinion 74 moves over the gear teeth of the disk 66 which rotate it and in turn rotates the axle 72. Also fixed to the axle 72 is a spur gear 76. The spur gear 76 is located on the inside wall of the component 42 of the front appendage 14, thus placing it inside of the appendage 14 when the two components 40 and 42 of the appendage 14 are put together in assembling the toy 10.

A hairpin spring 78 is wound around the axle 48 and has one of its ends abutted against peg 68. The other of its ends is located on a projection 80 formed as a part of the wall of component 42 of the front appendage 14. In moving the front appendage 14 with respect to the body 12, the spring 78 is tensed when the appendage 14 moves counterclockwise as in viewed in FIG. 1. When the front appendage 14 is as seen in FIG. 2 the spring 78 is so tensed, and as such, it biases against the projection 80 to rotate the front appendage 14 clockwise as viewed in moving from FIG. 2 to FIG. 3 to FIG. 1. Spring 78 is thus the restoring force to move the appendage 14 back to its original position, from the position seen in FIG. 2 to the position seen in FIG. 1. It thus constitutes the activating portion of the driving mechanism of the toy 10.

Figure 5:
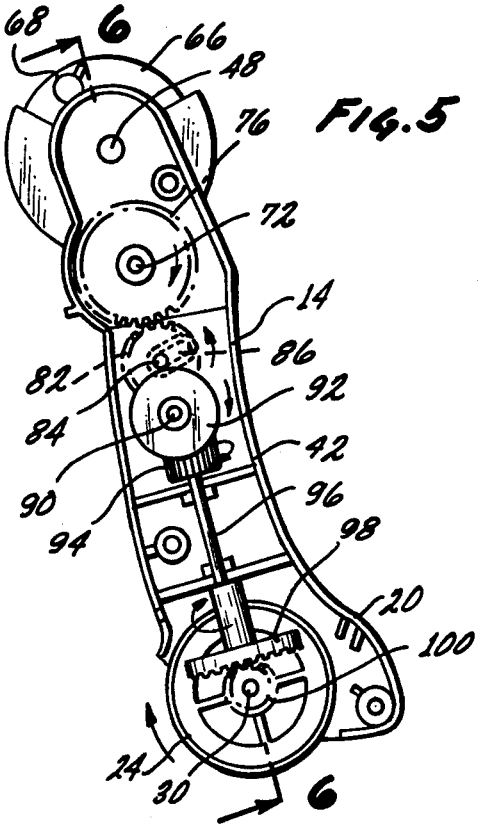
FIG. 5 is a side elevational view showing certain components in the interior of the front movable appendage of FIG. 1.

Located below spur gear 76 is a swing gear 82. Swing gear 82 is attached to its axle 84. Its axle 84 is free to slide within slots, one of which, slot 86, is seen on the inside of the component 42 of the front appendage 14. An identical slot, not seen or numbered, would be formed on the inside of component 40 such that the axle 84 would be movably suspended within the interior of the front appendage 14. When the axle 84 is seen in the position as shown in FIG. 5, the teeth of the swing gear 82 engage both the teeth of the spur gear 76 and the teeth of a pinion 88. When the axle 84 slides to the uppermost end of the slot 86 the swing gear 82 disengages from pinion 88.

Pinion 88 is located on an axle 90 which also carries a crown gear 92. Both crown gear 92 and pinion 82 rotate in conjunction with one another. Crown gear 92 further meshes with pinion 94. Pinion 94 is fixed to axle 96 which also contains a crown gear 98 also fixed thereto. Crown gear 98 in turn meshes with pinion 100 which is fixedly mounted onto axle 30. Axle 30 therefore rotates in response to rotation of pinion 100. Wheel 24 as well as its unseen mate, which is identical to it, rotate in conjunction with rotation of axle 30.

Because of the presence of swing gear 82, when the crown gear 92 and thus the pinion 88 located directly beneath it in FIG. 5 are rotated clockwise, or the spur gear 76 is rotated counterclockwise, swing gear 82 will slide on its axle 84 in the slot 86, breaking the gear train between the spur gear 76, the swing gear 82 and the pinion 88. This allows for free rotation of the wheel 24 and concurrently the axles 30. When the front appendage 14 is rotated clockwise as seen in FIGS. 1, 2, 3 and 5, the pinion 76 is rotated counterclockwise and during such counterclockwise movement of the appendage 14 the swing gear 82 also moves out of engagement with the pinion 88.

However, when the appendage 14 moves clockwise under the bias of spring 78 as seen in FIGS. 1, 2, 3 and 5, the spur gear 76 is rotated clockwise as the pinion 74 rides around the teeth on the disk 66. This clockwise rotation of the spur gear 76 engages against the swing gear 82, driving the axle 84 within the slot 86 in the position as seen in FIG. 5. This completes the gear train between the spur gear 76, the swing gear 82 and the pinion 88 such that clockwise rotation of the front appendage 14 as seen in FIGS. 1, 2, 3 and 5 result in clockwise rotation of the axle 30 and thus the wheel 24 in these same Figs. This clockwise rotation of the wheel 24 and its unseen mate will drive the toy 10 across a support surface as the body 12 moves upwardly from the support surface and the wheels 24 and 26 move toward each other.

It is evident then, that when using the toy 10, the child simply has to push down onto the body 12. This spreads the front and rear appendages 14 and 16 from the position seen in FIG. 1 to the position seen in FIG. 2. Concurrently, the wheels 24 and 26 roll along the support surface with no effect. As was noted previously, this concurrently tenses the spring 78. When the child releases the toy 10, the tension thus created in the spring 78 moves appendage 14 back under the body 12 such that wheels 24 and 26 come back together. In so moving the appendage 14, the wheel 24 is driven in the direction such that it engages the support surface and pulls the toy 10 along the support surface as the toy 10 concurrently raises back up to its upright position as seen in FIG. 1. When the toy has reached the upright position as seen in FIG. 1, the inertia imparted to the toy is such that the toy now rolls along the support surface with the wheel 24 and its unseen mate continuing their clockwise rotation as viewed in FIG. 1. This rotation, however, is transferred to the crown gear 82 and to the pinion 88 lying underneath it in FIG. 5 such that they rotate clockwise. This clockwise rotation also moves swing gear 82 such that its axle 84 slides in the slot 86. This movement is in a direction such that the swing gear moves out of position as seen in FIG. 5 and disengages with the spur gear 76.

It was noted earlier that, as the appendage 14 moves back to its upright position, the swing gear 82 is in the position as shown in FIG. 5 when the wheel 24 is rotating clockwise. However, to do so, it must concurrently be rotated by the spur gear 76 such that it is forced downwardly into the position shown in FIG. 5. When the spur gear 76 is no longer rotating clockwise as seen in FIG. 5, it no longer actively moves the swing gear to this position and clockwise rotation of the crown gear 92 and the pinion 88 underneath it results in movement of the swing gear 82 from the position seen in FIG. 5 to a position wherein its axle 84 is located in the opposite end of the slot 86. The presence of the swing gear 82 thus allows for transfer of the driving force resulting from the movement of the front appendage 14 from the position shown in FIG. 2 to the position shown in FIG. 1 to rotate the wheel 24 and its unseen companion to initially propel the toy forward. However, it allows for free wheeling of the toy 10 on a support surface once the toy 10 is in its upright position as is seen in FIG. 1 and is moving forward under its own inertia. Additionally, the toy 10 can simply be shaped across a support surface by the child, with free wheeling of the wheel 24 and its unseen companion via movement of the swing gear 82.

I claim:

1. A toy capable of moving on a support surface which comprises:

a body having at least a first member attached thereto, said body including a surface contact means, said first member having ends, said first member pivotally mounted about the first of its ends to said body about a pivot means centered on an axis of rotation;

an arcuate gear rack fixedly mounted to said body about said axis of rotation;

a spring means having ends, one of said ends attaching to said body and the other of said ends attaching to said first member;

a wheel means located on the other of said ends of said first member;

a gear train means included on said first member, said gear train means including a gear located on said first member in association with said axis of rotation so as to engage said gear rack, said gear train operatively connected to said wheel means for rotating said wheel means;

said first member moving with respect to said body by pivoting about said axis of rotation and when said first member is moved with respect to said body, said gear moving with respect to said gear rack and in moving with respect to said gear rack being rotated by said gear rack, rotation of said gear transferred to said gear train, in response to pivoting of said first member with respect to said body in a first direction said second end of said first member moving away from said surface contact means and concurrently at least a portion of said body moving downwardly toward said support surface and in response to said pivoting of said first member with respect to said body in the opposite direction said second end of said first member moving toward said surface contact means and concurrently at least a portion of said body moving upwardly away from said support surface;

said toy supported on said support surface by said surface contact means and said wheel means;

said spring means being activated upon moving said first member in said direction wherein said second end of said first member moves away from said surface contact means and when so activated said spring means capable of moving said first member with respect to said body such that said second end of said first member moves back toward said surface contact means and concurrently as said second end moves toward said surface contact means said wheel means being rotated with respect to said first member by said gear train means, said rotation of said wheel means moving said wheel means across the support surface to propel said toy across said support surface.

2. The toy of claim 1 wherein:

said surface contact means comprises an extension on said body, said extension having a surface contact member contacting said support surface to partially support said toy on said support surface.

3. The toy of claim 2 wherein:

said extension means comprises a second member, said second member having ends, said second member pivotally mounted to said body about one of its ends, said surface contact member located at the other of said ends of said second member.

4. The toy of claim 3 wherein:

said surface contact means comprises a second wheel means located at the other end of said second member, said second wheel means capable of rotating on said support surface;

said first member and said second member both pivoting with respect to said body such that movement of said wheel means away from said second wheel means biases said spring means and when so biased said spring means moving said first member and said second member such that said wheel means and said second wheel means are moved toward one another.

5. The toy of claim 4 including:

coordinating means operatively associated with both said first member and said second member, said coordinating means transferring pivotal movement of one of said first member or said second member to the other of said first member or said second member.

6. The toy of claim 5 wherein:

both said wheel means and said second wheel means comprises at least one wheel located on the respective ends of said first and said second members, said wheel located on said second member freely rotatable on said second member and said wheel located on said first member rotatable in a first direction by said gear train means.

7. The toy of claim 6 wherein:

said coordinating means comprises a second gear train a portion of which is located in conjunction with said first member and a portion of which is located in conjunction with said second member, movement of said first member being communicated to said second member by said second gear train means.

8. The toy of claim 7 further including:

a third member, said third member pivotally attaching to said body, said second gear train means further including a portion attaching to said third member such that movement of said first member is communicated to said third member.

9. A toy which comprises:

a first body element and a second body element, at least said first body element being elongated and having an upper end and a lower end, the upper end of said first body element hinged to said second body element about an axis of rotation whereby said first and second body elements pivot with respect to one another around said axis of rotation;

a wheel axle located at said lower end of said first body element;

at least one first body wheel located on said wheel axle so as to rotate in conjunction with said wheel axle;

said second body element including at least one second body wheel rotatably mounted thereon distal from said axis of rotation, together said first body wheel and said second body wheel supporting said toy on a support surface said toy capable of rolling on said wheels on said support surface;

a circular gear rack fixedly mounted to said second body element about said axis of rotation;

a spring having ends, one of said ends attaching to said first body element and the other of said ends attaching to said second body element, said spring being positioned with respect to said first and said second body elements such that a bias is introduced into said spring when said first and second body elements are pivoted about said axis of rotation in a direction displacing said first body wheel away from said second body wheel, said bias introduced into said spring biasing said first and said second body elements in a direction so as to move the first body wheel and said second body wheel toward one another;

a first gear rotatably mounted in said first body element in association with said gear rack so as to engage said gear rack and to travel around said gear rack and can be rotated by said gear rack as said first and said second body elements pivot about said axis of rotation;

an axle gear fixedly mounted to said wheel axle in said first body element so as to rotate in conjunction with said wheel axle;

a first gear train including at least one gear, said first gear train rotatably mounted in said first body in association with said first gear so as to be rotated in conjunction with rotation of said first gear;

a second gear train including at least one gear, said second gear train rotatably mounted in said first body element in association with said axle gear so as to rotate in conjunction with said axle gear;

an intermediate gear rotatably mounted in said first body element and positionable in said first body element between a first position and a second position wherein in said first position said intermediate gear engages both said first and said second gear trains to transfer rotation from said first gear train to said second gear train whereby said axle gear rotates in response to rotation of said first gear, and in said second position said intermediate gear disengages from at least one of said first and said second gear trains to disrupt transfer of rotation from said first gear train to said second gear train.

10. The toy of claim 9 wherein:

said first body element comprises a first body member;

said second body element comprises an intermediate body and an extension, said extension pivotally attaching to said intermediate body about a second axis of rotation;

said first body member pivotally attaching to said intermediate body about said axis of rotation, said circular gear rack fixedly mounted in said intermediate body about said axis of rotation;

said second body wheel rotatably mounted to said extension distal from said (second) axis of rotation;

said spring connected between said first body member and said intermediate body.

11. The toy of claim 10 further including:

coordinating means operatively associated with said first body member and said extension, said coordinating means transferring pivotable movement of one of said first body member or said extension about said respective axis of rotation and said second axis of rotation to the other of said first body member or said extension.

* * * * *